US007491039B2

(12) United States Patent
Lopez

(10) Patent No.: US 7,491,039 B2
(45) Date of Patent: Feb. 17, 2009

(54) COMPRESSOR

(76) Inventor: Arthur V. Lopez, 36324 Capri Dr., Winchester, CA (US) 92596

( * ) Notice: Subject to any disclaimer, the term of this patent is extended or adjusted under 35 U.S.C. 154(b) by 251 days.

(21) Appl. No.: 11/604,970

(22) Filed: Nov. 27, 2006

(65) Prior Publication Data

US 2007/0183912 A1 Aug. 9, 2007

Related U.S. Application Data

(60) Provisional application No. 60/765,162, filed on Feb. 6, 2006.

(51) Int. Cl.

| | |
|---|---|
| ***F04B 43/08*** | (2006.01) |
| ***F04B 43/12*** | (2006.01) |
| ***F04B 45/06*** | (2006.01) |
| ***F04B 43/00*** | (2006.01) |
| ***F04B 45/02*** | (2006.01) |

(52) U.S. Cl. ..... 417/475; 417/473

(58) Field of Classification Search ..... 417/269, 417/320, 412, 413.1, 472, 473, 474, 475, 417/539; 92/37, 71

See application file for complete search history.

(56) References Cited

U.S. PATENT DOCUMENTS

| | | | | | |
|---|---|---|---|---|---|
| 1,715,735 | A * | 6/1929 | Banning, Jr. | ..... | 417/473 |
| 2,392,279 | A * | 1/1946 | Woods | ..... | 91/180 |
| 2,456,133 | A * | 12/1948 | Lipscomb | ..... | 417/475 |
| 4,529,106 | A * | 7/1985 | Broadfoot et al. | ..... | 222/207 |
| 4,801,249 | A * | 1/1989 | Kakizawa | ..... | 417/269 |
| 4,902,206 | A * | 2/1990 | Nakazawa et al. | ..... | 417/394 |
| 5,588,811 | A * | 12/1996 | Price | ..... | 417/350 |
| 5,700,135 | A * | 12/1997 | Inokuchi et al. | ..... | 417/269 |
| 6,382,928 | B1 * | 5/2002 | Chang | ..... | 417/269 |

* cited by examiner

*Primary Examiner*—Devon C Kramer
*Assistant Examiner*—Alexander B Comley
(74) *Attorney, Agent, or Firm*—Donn K. Harms

(57) ABSTRACT

An air compressor formed of a plurality of collapsible members engaged between opposing rotating side members. The collapsible members alternate between a collapsed state and enlarged state during rotation around the side members which are engaged to polygonal segments of a generally circular rotating frame. Air compressed in each of said collapsible members during rotation toward the collapsed state is communicated to a reservoir in sealed communication with each of the plurality of bellowed members. The reservoir acts to hold-compressed air for use for powering air powered devices.

9 Claims, 10 Drawing Sheets

NOTE:

1. CIRCULAR PLANAR MEMBERS ARE MOUNTED WITH MEMBER 17 EQUALLY SPACED ADJACENT TO THE CIRCUMFERENCE OF MEMBER 26. TWO ARE SHOWN ON THE DRAWING FOR CLARITY AND SIMPLICITY.

NOTE:

1. SIDEWALLS OF MEMBER 17 ARE DEPICTED AS STRAIGHT LINES INSTEAD OF BELLOW-LIKE WALLS FOR SIMPLICITY.

$$\frac{X}{Y} = \frac{[(R+r) - D/2\cos\theta]}{[(R-r) + D/2\cos\theta]}$$

Where,

"R" = distance from point "M" to the center of the planar member
"r" = radius of the circular planar member
"D" = diameter of the hollowed collapsible member
" 2θ" = angles in degrees between two circular planar members

COMPRESSOR

This application claims the benefit of U.S. Provisional Application Ser. No. 60/765,162, filed on Feb. 6, 2006, which is incorporated herein for reference.

FIELD OF THE INVENTION

The present invention is directed to compression apparatus for air or gas. More particularly, the disclosed device provides a compressor with a very high compression efficiency in relation to energy expended for its operation. This increased efficiency is provided through employment of a compression apparatus employing equal, opposite and collinear forces acting on opposite face of a rotating discs engaged to a polygonal frame formed of individual linear segments. The unique arrangement of the polygonal frame and discs and collapsible bellows is utilized to impart compression on large volume of air or gas with minimal energy spent on the mechanical requirements for that compression.

BACKGROUND OF THE INVENTION

In general, all prior art compressors compress gaseous matter by applying forces that are either normal to, or at angle and to, the direction of compression. A large amount of energy is necessary to generate the mechanical force required by conventional prior art compressors which take air or gas at atmospheric pressures and store it under higher pressures in the reduced confines of a reservoir tank. The high energy requirements of motors used to drive these prior art compressors draw more energy from conventional energy sources.

In general, conventional compressors employ many engaged parts resulting in increased dynamic friction over the increased number of engaged surfaces which of course results in increased energy losses from frictional engagement. This energy consumption for frictional parts engagement is aside from the actual energy expended to mechanically compress the gaseous matter itself.

Another disadvantage of prior art compressors is the ever present sliding contact between compressor parts such as piston and piston rings to cylinder walls, vanes to compressor housing. These and other types of sliding contacts result in a significant source of dynamic friction and resulting heat. Lubrication between parts in sliding contacts is constant requirement in these conventional compressors to protect the continuously friction-heated parts from premature wear and tear.

Another very important consideration concerning the operating parts of conventionally employed compressors is the requirement that operating parts must be machined to extremely close tolerances and the surfaces of the parts be made and maintained to a high degree of finish in order to prevent compression losses. This results in extra costs in time and materials during manufacture.

The disclosed device herein, overcomes the shortcomings of prior art and provides a compressor for compressing air or any gaseous matter that is efficient to operate and easily manufactured. These benefits are provided by employing an entirely new method of compressing gaseous matter. It is an established engineering principle that when forces are equal, opposite, and collinear, no resultant moment is produced at any point in space. The apparatus herein described and disclosed, utilizes this engineering principle in a new and novel fashion to provide for the compression of large volumes of gaseous matter with an efficiency far exceeding that of any prior art compressor. Consequently, a unique and efficient apparatus for air compression is provided which has great efficiency. This is provided by employing equal, collinear, and opposite forces acting on opposite faces of a rotating wheel or discs, and with the forces having no relative movement with the wheel, producing such efficient compression.

With respect to the above description, before explaining at least one preferred embodiment of the invention in detail, it is to be understood that the invention is not limited in its application to the details of construction and to the arrangement of the components or steps set forth in the following description or illustration in the drawings. The various apparatus and method of the invention are capable of other embodiments and of being practiced and carried out in various ways which will be obvious to those skilled in the art once they review this disclosure.

Also, it is to be understood that the phraseology and terminology employed herein, are for the purpose of description and should not be regarded as limiting. Therefore, those skilled in the art will appreciate that the conception upon which this disclosure is based may readily be utilized as a basis for designing of other devices, methods and systems for carrying out the several purposes of the present compression machine. It is important, therefore, that the objects and claims be regarded as including such equivalent construction and methodology in so far as they do not depart from the spirit and scope of the present invention.

Further objectives of this invention will be brought out in the following part of the specification wherein detailed description is for the purpose of fully disclosing the invention without placing limitations thereon.

SUMMARY OF THE INVENTION

The device as herein described and disclosed, employs a unique indirect means to compress air or gaseous matter inside a hollow bellowed member. A frame having a segmented polygonal shape providing rotational engagement with circular planar members and the bellowed members, provides means to compress air or gaseous matter taking advantage of the principle that where forces are equal, collinear, and are acting in opposite directions, they will not produce a resultant moment at any point in space. Consequently, the hollow, bellowed and collapsible members, rotationally engaged around the segmented polygonal frame, are compressed starting at a widest point in their rotation around the segments of the polygonal frame and ending in the narrowest point of their rotation around the segments of the frame. The resulting plurality of rotationally engaged hollowed collapsible bellows, in an operative sealed angled engagement to adjacent circular planar members, produces large volume of compressed gaseous matter at a relatively high pressure.

The above noted indirect compression is attained by the employment of circular members centrally engaged upon each linear segment or leg forming the polygonal frame. The individual segments forming frame, are engaged to adjacent segments using a U-joint or constant velocity joint or similar means for rotating angled engagement, to form a polygonal frame with a generally circular shape. The individual segments engaged to the circular members, the collapsible hollowed bellows engaged to the circular planar members, and all other components such as discharge piping, will all rotate at the same speed.

A plurality of collapsible hollowed bellows are in a sealed engagement between each pair of circular planar members and each bellows are engaged at the same fixed distance from the linear segments where it rotates. The circular planar members are engaged at a central portion of the individual linear segments normal to the axis of individual linear segments. The polygonal shape of the frame, provided by the individual segments, causes the opposing side portions of each pair of planar members outside the circumscribed area of the polygonal frame to be spaced a larger distance from each other than the respective opposite side portions rotating inside the circumscribed area of the frame. The result is a plurality of narrowing distances or paths between each pair of planar circular members as they rotate from outside the circumscribed area of the polygonal frame toward the inside of the circumscribed area, and, a plurality of widening distances as they rotate from the inside of the circumscribed area of the frame to the outside.

During rotation of the collapsible, hollowed bellows engaged adjacent to the circumference of the circular planar members, and in sealed engagement between each pair of circular planar members engaged to segments forming the polygonal frame, each of the hollowed bellows is compressed to a collapsed position following the path formed between each pair of circular planar members as they rotate from the outside of the circumscribed area of the polygonal frame toward the circumscribed area of the frame.

Each of the plurality of collapsible, hollowed members is engaged between each pair of circular planar members to positions wherein all the collapsible members are aligned with respective adjacent collapsible members engaged to adjacent pair of circular planar members. On all such sealed engagement of the collapsible members to the circular members, each collapsible member is substantially equidistant from the preceding and subsequent collapsible member in like engagement.

The result is a plurality of collapsible members in a circular engagement around each individual segment of the polygonal frame, located a fixed distance from each other on the plurality of paired circular members. As noted, all of the linear segments members forming the polygonal frame, are engaged to adjacent segment members in the frame, using means for rotational angled engagement of the distal ends of the segments to adjacent segment distal ends, such as a universal or constant velocity joints. Consequently, all components rotate around the segments forming the frame at the rotation speed of the segments.

The collapsible, hollowed, bellowed members rotating with, and in sealed engagement with each pair of circular planar members rotate from the widest point to the narrowest point between each pair of circular members. As the circular members rotate around each respective individual segment of the frame, the collapsible members engaged to the circular members follows the alternating narrowing and widening gap between adjacent points of adjacent circular members. This alternating narrowing and widening gap between points on adjacent circular members will cause the collapsible members to follow this alternating event.

The narrowing path or gap between the rotating circular members will thereby compress the collapsible members and cause any gaseous matter inside the collapsible members to be compressed together with the collapsible member. It is to be noted too, that any force due to gas pressure developed inside the collapsible member on opposite planar sides of the circular members will cancel out each other as the force developed by the gaseous pressure is acting normal to faces of the circular member.

Power for the apparatus, while reduced considerably for the work accomplished, would be provided by conventional motors or engines such as an electric motor. Mechanical means for engagement to the circular members, to the motor, will thereby provide means to rotate all the circular members at the speed determined by the motor rotation communicated. Such mechanical engagement can be a chain and sprocket arrangement or a direct gear drive on the circumference of the circular member or a belt driving devices engaged to the circumference of the circular members. The rotation thereby communicated to all circular members and linear segments of the frame will rotate all of the circular members and compress and decompress the bellowed members to compress and intake air or gas during operation.

It is therefore an object of the present invention to provide an apparatus and method to compress gaseous matter by taking advantage of force cancellation, to gain compression efficiency.

It is a further object of this invention to use a unique configuration of polygonal frame and compression components rotating in a circular engagement, to eliminate or minimize energy loss due from friction of communicating parts in a compressor.

An additional object of this invention is the provision of a gas compression apparatus which is easy to develop, construct, maintain and operate.

Yet another object of this invention is the provision of a compressor which operates at lower temperatures due to less frictional part engagement.

A still further object of this invention is the provision of a compressor that is easily maintained even in dirty or wet environments that would disable conventional compressors.

These together with other objects and advantages which become subsequently apparent reside in the details of the construction and operation of the invention as more fully hereinafter described and claimed, reference being had to the accompanying drawings fonning a part thereof, wherein like numerals refer to like parts throughout.

DETAILED DESCRIPTION OF THE PREFERRED EMBODIMENTS OF THE INVENTION

Figure 1:
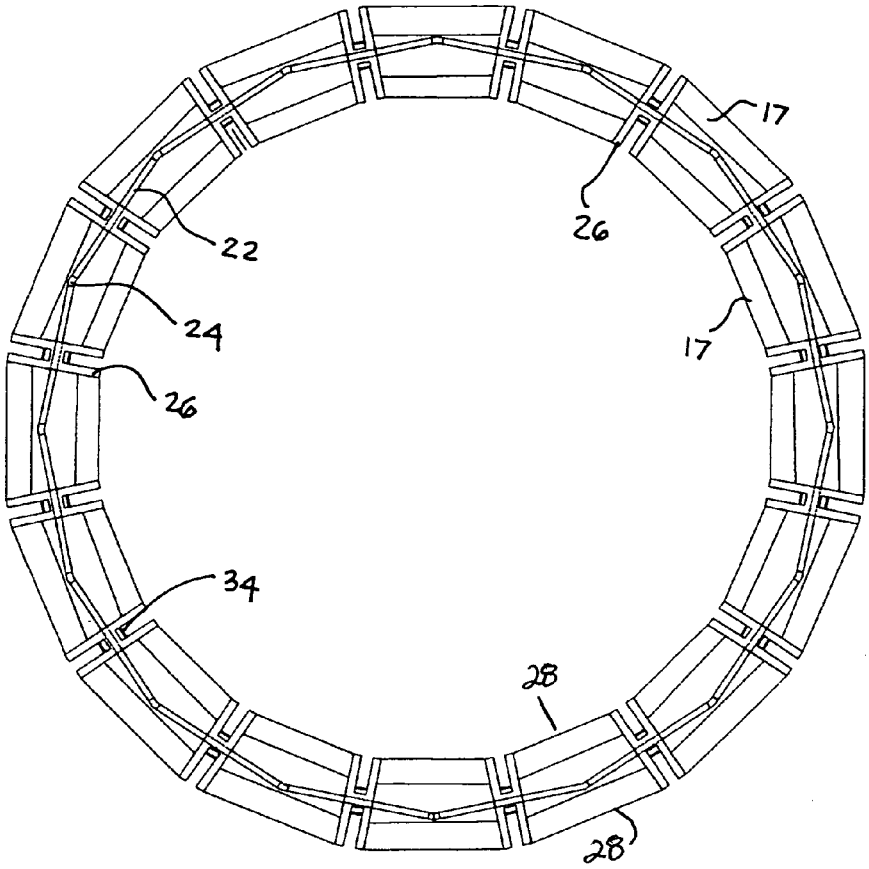
FIG. 1 depicts a top plan view of the device.
Figure 2:
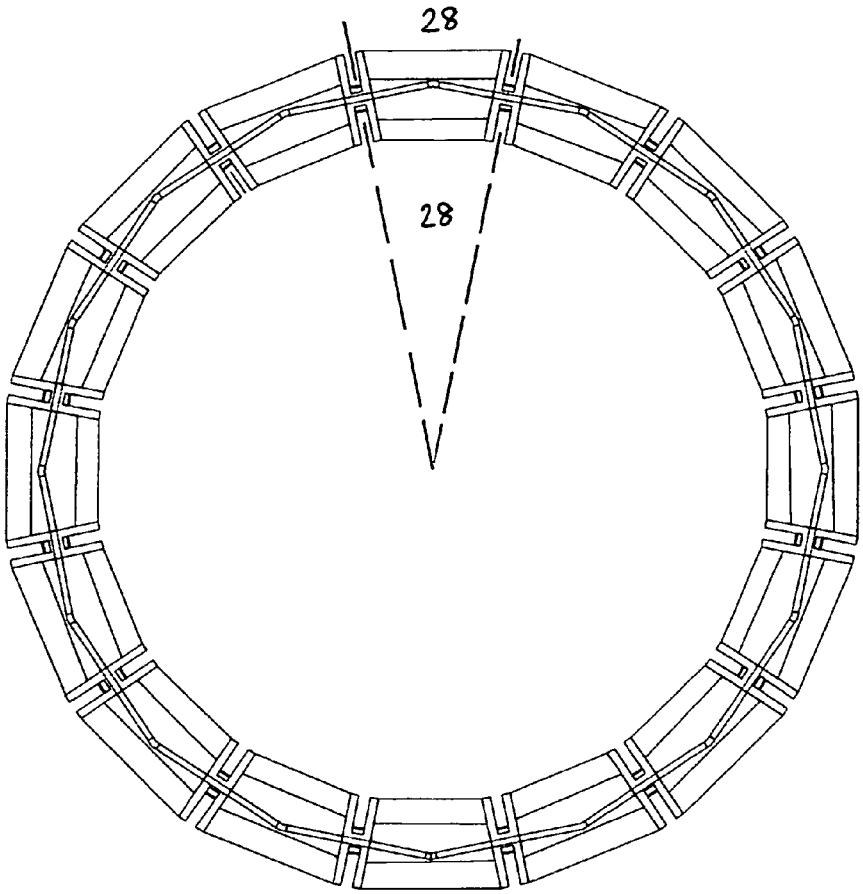
FIG. 2 depicts a view of the device showing the circular planar members.
Figure 3:
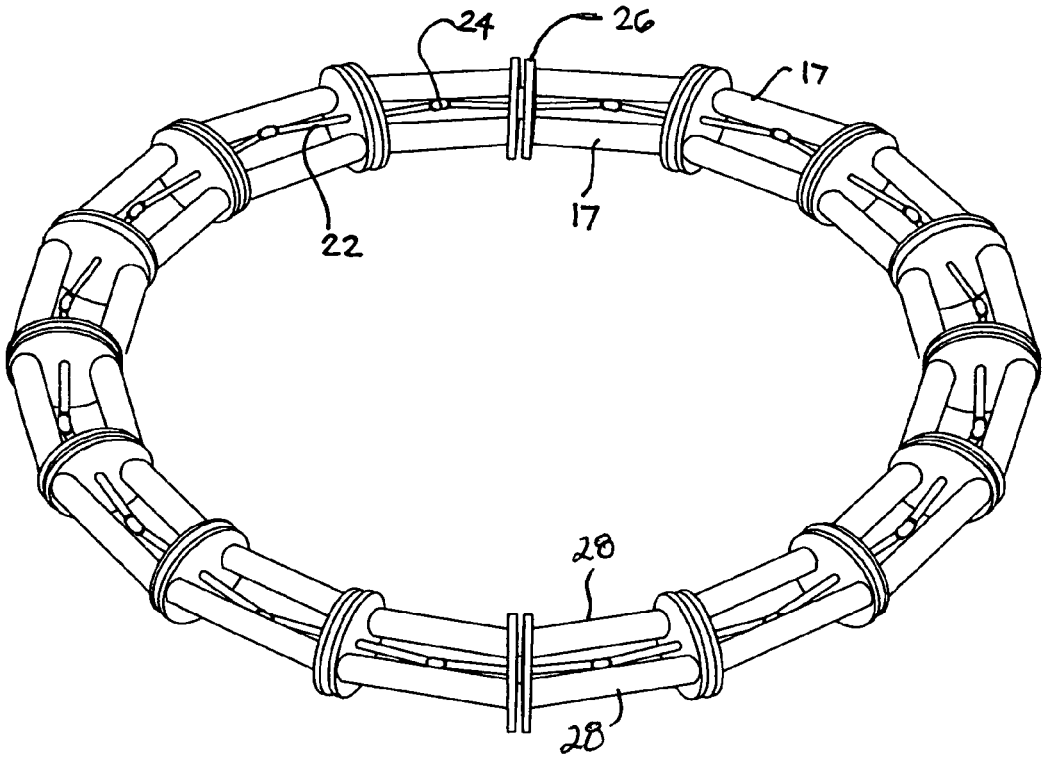
FIG. 3 depicts a perspective view of the device.

Referring now to the drawings FIGS. 1-12, wherein similar parts are identified by like reference numerals, there is seen in FIGS. 1, 2 and 3 a top view and perspective view showing the operational engagement between the polygonal frame 14, the circular planar member 26, and the collapsible, hollowed and bellowed members 17.

The frame 14 is polygonal shape having a generally circular or annular appearance and is formed of individual linear segment 22. The individual segment 22 which form the frame 14, are engaged to adjacent segment 22 to form the polygonal frame using means for rotational engagement such as a constant velocity joint or a universal joint 24. The segment 22 so engaged are adapted for rotational engagement upon a plurality of vertical risers 31 which will be employed to operatively maintain the device above the ground or mounting surfaces upon which it rests during operation. A bearing 34 or similar means for supported rotational engagement, provides means for engagement of the linear segment 22 to the vertical riser 31 supporting the frame. The bearing 34 can be adapted to engage a hub in an "H" shaped embodiment of the circular member 26 which is formed in the space extending from the circumference of the two sides of the circular member 26 to the hub. Or using a larger bearing 34 an engagement with the circumference of the circular members 26 could provide the rotational engagement, or such rotational engagement can be provided by other means for rotational elevated engagement as would occur to those skilled in the art.

At a center section of each segment 22 is engaged one of a plurality of two-sided circular planar member 26 each being at an angle normal to the axis of its respective engaged segment 22. As can be seen in FIGS. 1,2, and 3, the polygonal shape provided by the individual segment 22 forms an angled passage 28 between each pair of circular members 26. This angled passage 28 is wider outside the circumscribed area of the frame 14 and narrower inside the circumscribed area of the frame 14.

Each of the two-sided circular members 26 being engaged to a central position of each segment 22 causes the circular member 26 to rotate at the same angular speed as the segment 22 to which it is engaged. As noted, the segments 22 forming the polygonal frame 14 are linked at their distal ends to adjacent segments 22 and all rotate at substantially the same angular speed in unison. This results to a like rotation at an equal angular speed of all of the engaged circular members 26.

Power to rotate the circular member 26 and engaged components would be provided by means for powered rotation such as an engine or electric motor. Means for connection to a motor may be provided by a chain or belt or direct gear drive or other means to communicate rotational power from the motor or engine to the circular member 26. One manner shown depicts a chain engaged along the circumference of the two-sided circular member 26. Those skilled in the art will realize other means to communicate rotational power to the device may be provided and such are anticipated.

Figure 7:
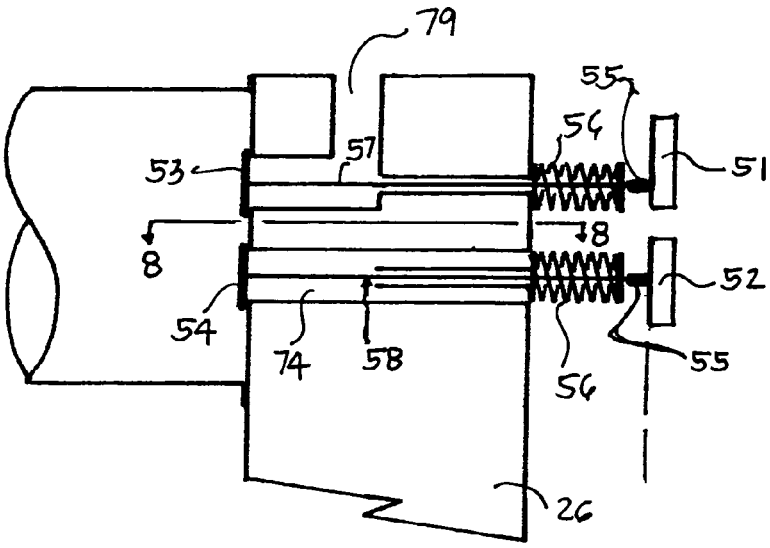
FIG. 7 depicts the operation of the rollers to translate the intake and exhaust valves during rotation of the planar members.
Figure 8:
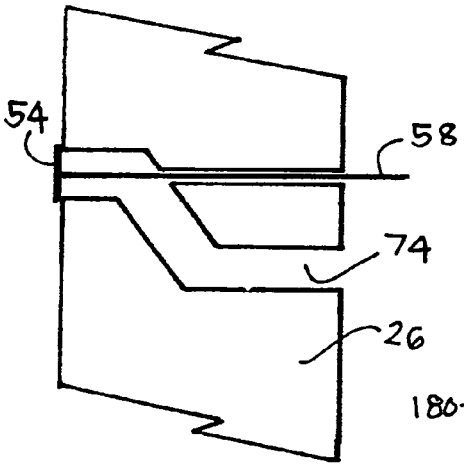
FIG. 8 shows a cut away view of the typical engagement of the exhaust valve stems relative to the discharge port.
Figure 9:
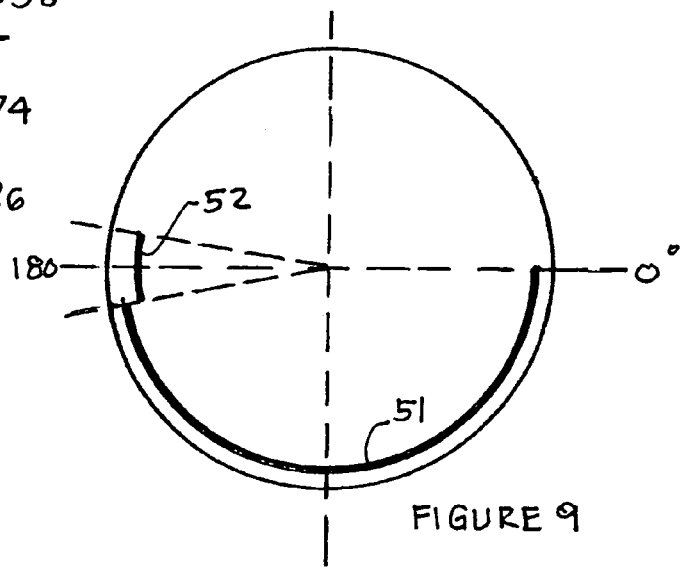
FIG. 9 depicts the timing of opening and closing of the valves during rotation of the planar members.

In FIGS. 7 and 9, spaced from the face of the circular member 26 opposite the face where collapsible member 17 are engaged, and located in the space or gap in between the two-sided circular member 26, are intake rail guide 51 and discharge rail guide 52 which are operatively mounted on the vertical riser 31 or some other means for such mounting. Intake guide rail 51 and discharge guide rail 52 are positioned at a pre-determined spacing from the inner faces of the two-sided circular member 26. This pre-determined spacing from the inner faces of circular member 26 will provide proper timed translation of the valve stems 57 and 58 and means for opening the intake and discharge valves 53 and 54 respectively.

In FIG. 7, as the circular member 26 rotates around the linear segment 22, rollers 55 at the end of intake valve stem 57 and at the end of discharge valve stem 58, which are both rotating together with circular member 26, will alternately be on operative and non-operative engagement with intake rail guide 51 and discharge rail guide 52 respectively. Means to provide smooth transition to and from operative and non-operative engagement of roller 55 to rail guide 51 and 52 will be provided such as slanted rail portion before and after roller 55 engagement to rail 51 and 52.

Figure 10:
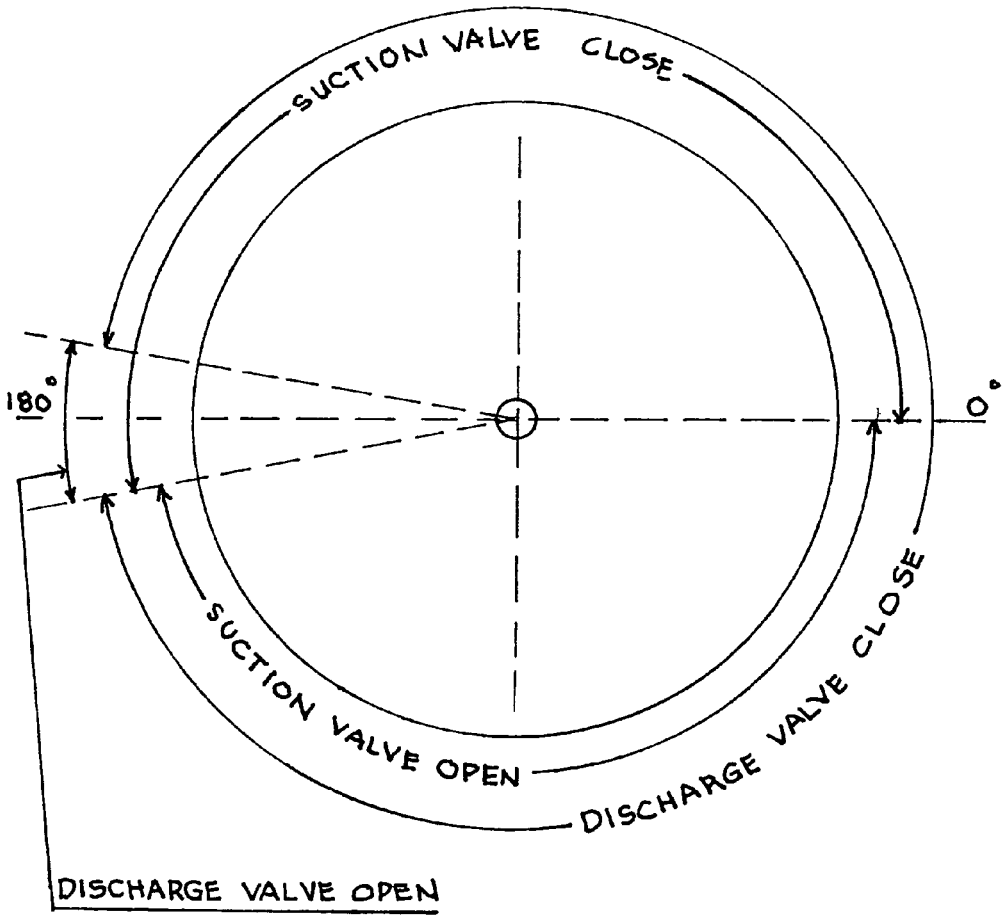
FIG. 10 shows the relative locations and timing of operative and non-operative engagement of intake and discharge rollers during operation of the device
Figure 11:
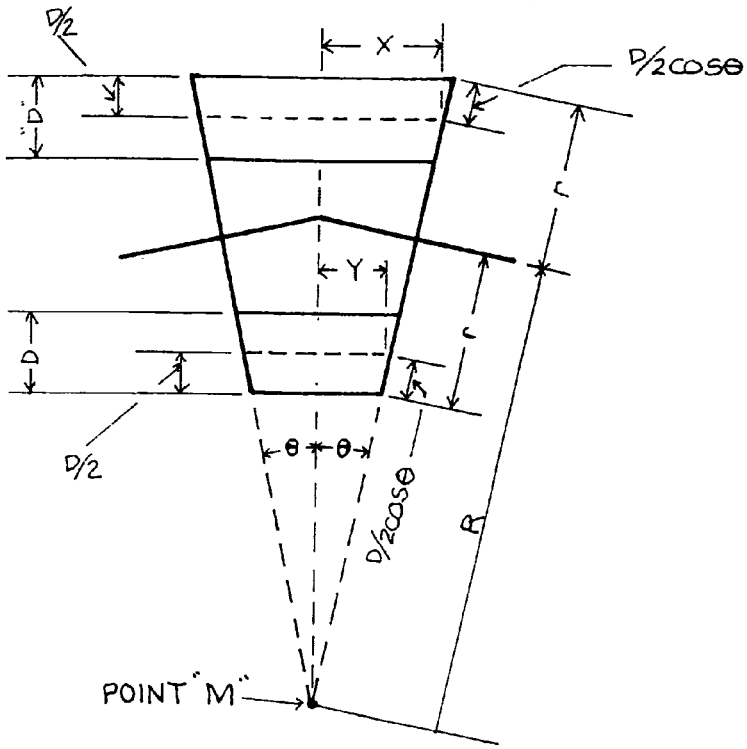
FIG. 11 is a graphical representation of the angles and dimension involved between the circular members when operatively engaged at a central portion of the individual segments.
Figure 12:
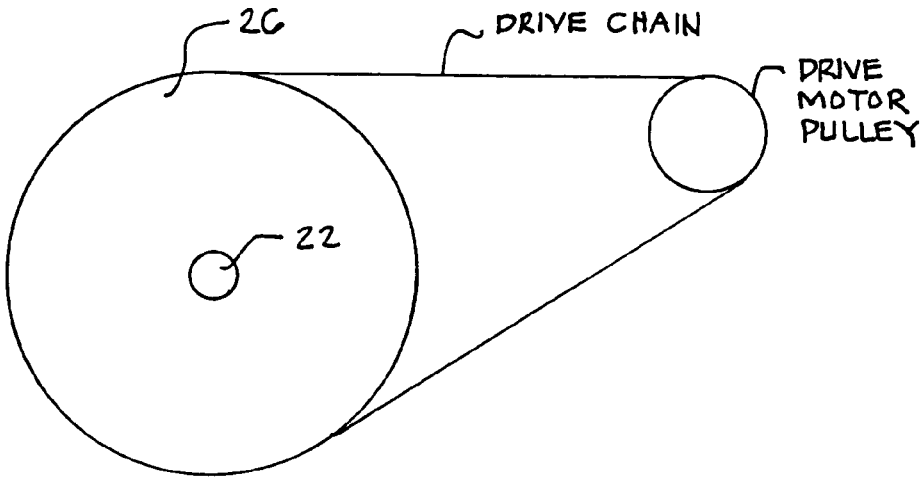
FIG. 12 shows methods of imparting rotational motion to the circular member and to the apparatus as a whole.

FIGS. 9 and 10 show the relative locations and timing of operative and non-operative engagement of intake and discharge rollers 55 with intake rail guide 51 and discharge rail guide 52 with respect to the horizontal line, that is, 0-180 degree line. As the roller 55 on the end of valve stem 57 and 58 comes into operative engagement with guide rails 51 and 52, valve stem 57 and 58 is translated inside the collapsible, hollowed and bellowed member 17 causing the intake valve 53 and discharge valve 54 to open according to its respective opening timing. As the intake valve opens and remains open, gaseous matter enter the inside of member 17 through intake passage 79, thereafter the intake valve closes as roller 55 on intake valve stem ceases to be in operative mounting to guide rail 51. As long as the intake valve 53 is open, the discharge valve 54 remains in a closed position. With roller 55 on both intake and discharge valve stem in non-operative engagement to rails 51 and 52 respectively, the gaseous matter as well as the walls of member 17 are compressed as the circular member 17 rotates around the axis of segment 22. This compression takes mechanical advantage and increased efficiency provided by the narrowing passageway as the circular member rotates from the outside of circumference of the frame to the inside of circumference of the frame, and the fact that where forces are equal, opposite, and collinear no moment is produced at any point in space.

As the roller 55 on the end of discharge valve stem is in operative engagement to guide rail 52, the discharge valve stem 58 is translated into the inside of member 17 causing the discharge valve to open according to its respective opening timing. As long as the discharge valve 54 is open, the intake valve is in close position. The return spring 56 on both intake and discharge valve mechanism closes both valves when roller 56 of both valve mechanism is in non-operative engagement to rail guides 51 and 52 respectively. Other means for biasing the valves to the closed position can be employed and are anticipated.

Of course those skilled in the art, will realize that other means for the timed opening and closing of the intake valve 53 and discharge valve 54 may be employed to operatively open and close them during rotation of the circular member 26. All other means for such timed opening and closing of the respective intake and discharge valves of each bellowed member during rotation of the circular member 26 as would occur to those skilled in the art are consequently anticipated in the scope of this invention.

Figure 4:
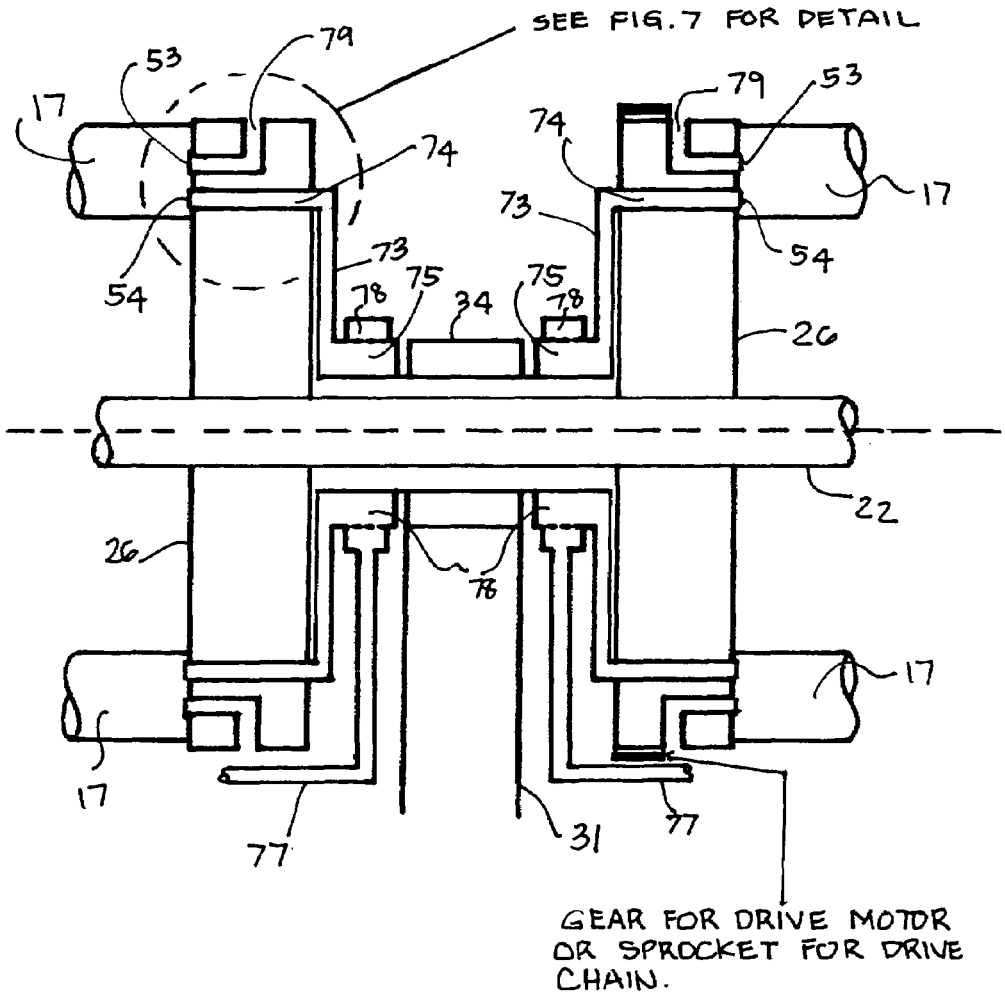
FIG. 4 depicts an enlarged view of the plenum engagement to the rotating shaft of the device.
Figure 5:
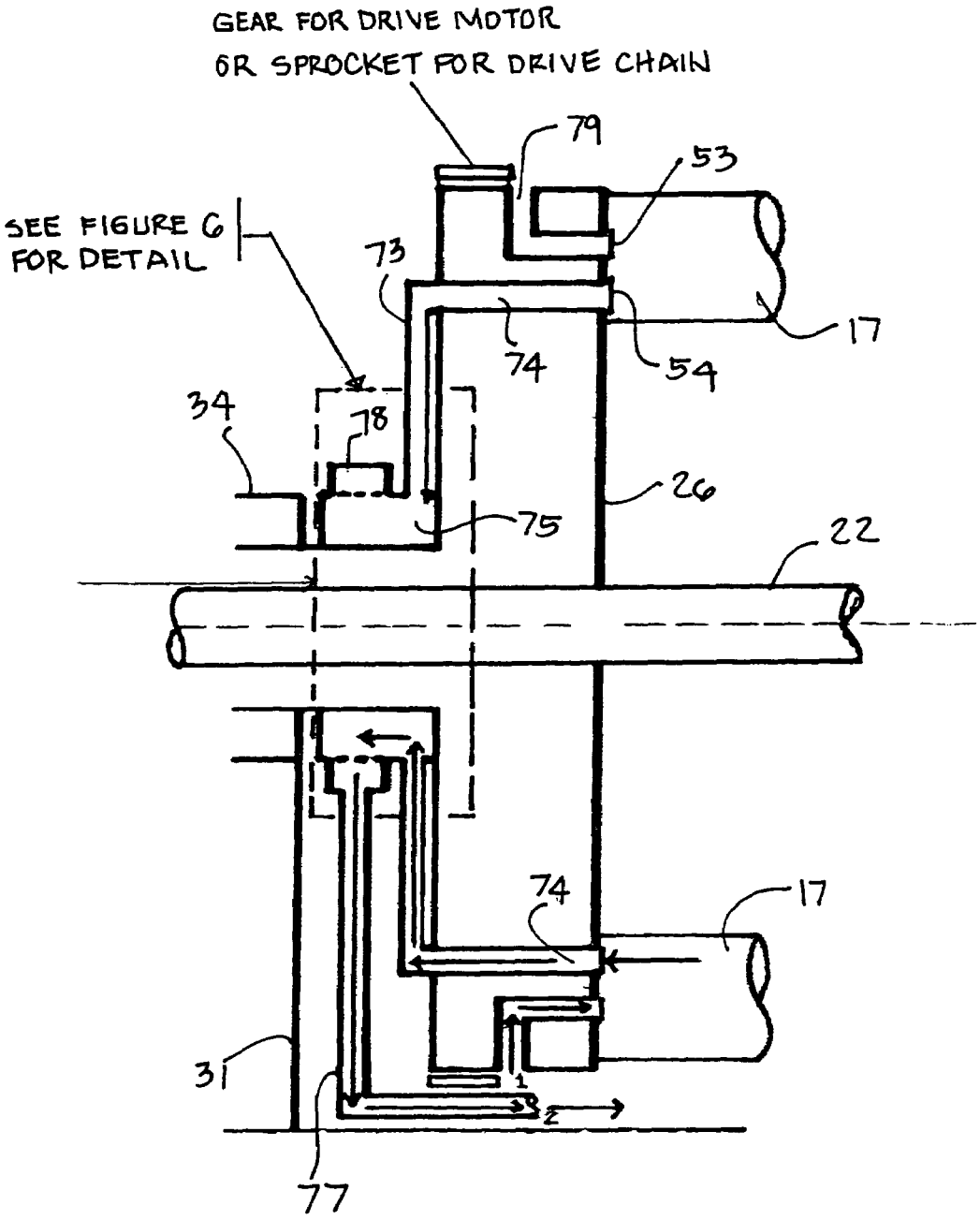
FIG. 5 depicts a more detailed view of the plenum and exhaust flow channels.
Figure 6:
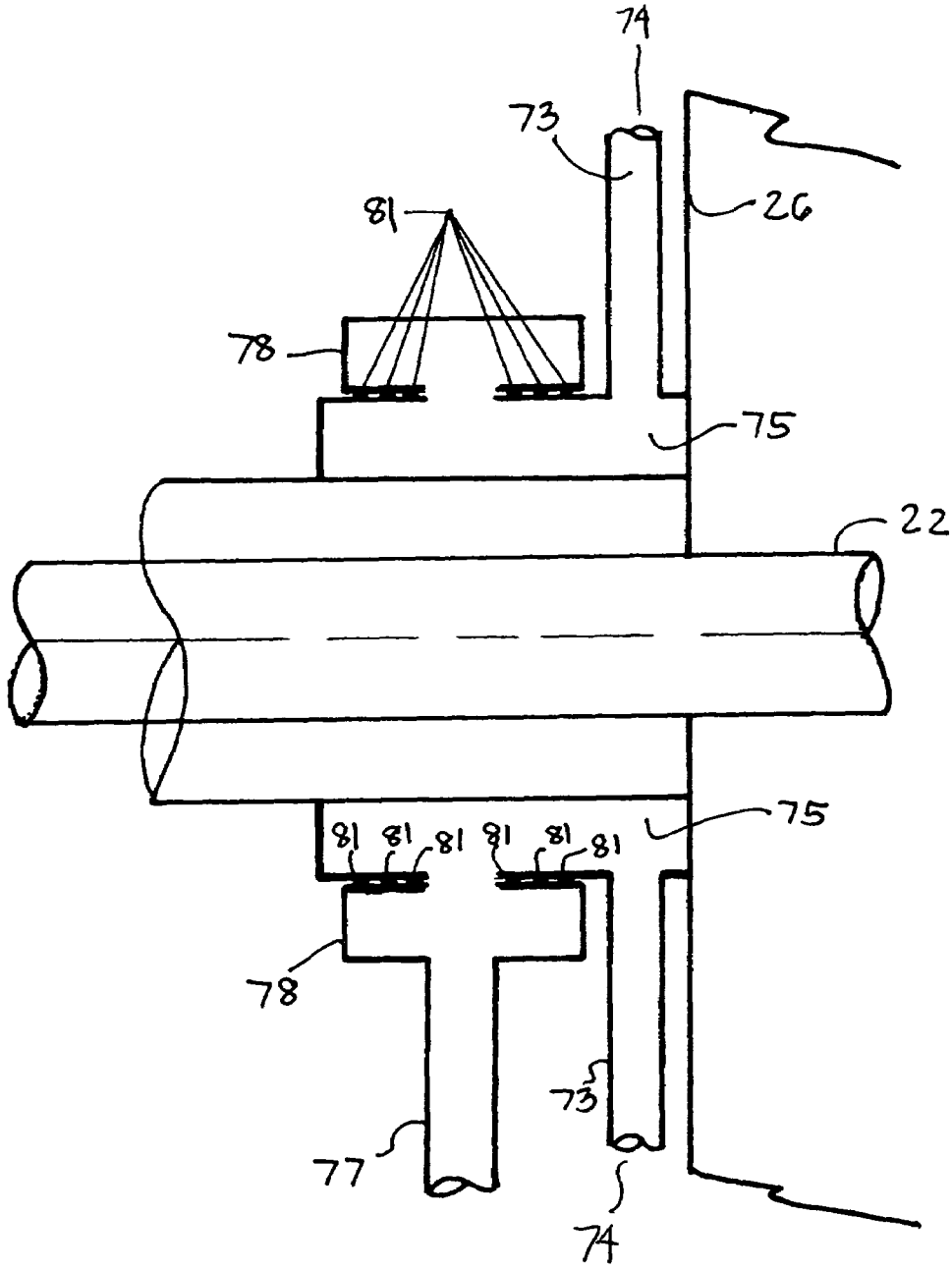
FIG. 6 shows the sealed engagement at the collection conduit.

Employing the rotating circular member 26 engaged to the linear member 22 comprising frame 14 to compress the bellowed members and using the aforementioned timed opening and closing of the valves, in operation as a compressor, the discharge valve 54, when opened by its translating valve stem will be in sealed communication with exhaust port 74, shown in FIGS. 4, 5 and 6, which is communicated to plenum 75 engaged to the shaft of member through conduit 73. The plenum 75, is in sealed communication while rotating, using means for an annular seal such as O-rings 81 with a collection conduit 78. All of the collection conduits 78 from all of the plenums 75 are in sealed communication through conduits 77 communicating with a reservoir tank 60.

Air ingress back into the interior of the members 17 is provided when the intake valve 53 is opened by translation of its valve stem 57 activated by the rail engaged roller 55 at the appropriate time and for the appropriate duration. While opened by the translated valve stem 57, air is communicated back into the member 17 from the intake port 79 through the intake valve 53 during the timing and duration of air intake as shown in FIG. 10.

During operation, each individual purge of air under pressure through the discharge valve 54 of each of the plurality of members 17 in the system, is communicated in its sealed communication to the reservoir 60 with the result being the reservoir 60 rapidly collects large volumes of pressurized air from the many members 17 in the system providing air bursts to it during their discharge. Because of the aforementioned advantages of the system from the unique angled circular members providing the means to compress the members 17, a very efficient air compressor is provided when engaged to a means for powered rotation of the member 26.

The method and components shown in the drawings and described in detail herein disclose arrangements of elements of particular construction, and configuration for illustrating preferred embodiments of structure of the present compressor invention. It is to be understood, however, that elements of different construction and configuration, and using different steps and process procedures, and other arrangements thereof, other than those illustrated and described, may be employed for providing a buoyancy engine system in accordance with the spirit of this invention.

As such, while the present invention has been described herein with reference to particular embodiments thereof, a latitude of modifications, various changes and substitutions are intended in the foregoing disclosure, and will be appreciated that in some instance some features of the invention could be employed without a corresponding use of other features, without departing from the scope of the invention as set forth in the following claims. All such changes, alternations and modifications as would occur to those skilled in the art are considered to be within the scope of this invention as broadly defined in the appended claims.

Further, the purpose of the foregoing abstract of the invention, is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting, as to the scope of the invention in any way.

What is claimed is:

1. An air compressor comprising:

a frame, said frame formed in a generally circular circumference formed of a plurality of individual linear members, each linear member having two ends and center portions between said ends;

means for rotational support of said frame above a surface;

means for rotational angled engagement of said ends of said linear members forming said frame, to adjacent said ends of said linear members;

a planar circular member located at said center portions of each of said linear members;

each planar circular member having two sides defining two opposing side surfaces;

adjacent said planar circular members engaged to adjacent said linear members thereby forming a plurality of pairs of planar circular members with facing respective said side surfaces;

said angled rotational engagement of said linear members placing said facing side surfaces of each of said pair of said pair of circular planar members at an angle to the other of said pair;

a pathway formed between said respective side surfaces of each said pair of planar circular members, said pathway being wider outside said circumscribed area of said frame, and narrowest inside said circumscribed area of said frame;

a plurality of collapsible members, engaged to said side surfaces adjacent to said member circumference and between each said pair of planar circular members;

said collapsible members having an internal cavity communicating with an intake aperture and a discharge aperture;

means for powered rotation of said planar circular and said linear members forming said frame for imparting a rotation of said linear members and said circular members toward said inside of said circumference;

said collapsible members engaged between said each said pair of planar circular members alternating between an enlarged dimension outside said frame circumscribed area, to a collapsed dimension inside said frame circumscribed area, during said rotation;

a first time duration during said rotation causing a translation of said collapsible members from said enlarged dimension to said collapsed dimension;

a second time duration during said rotation causing a second translation of said collapsible members from said collapsed dimension to said enlarged dimension;

means to communicate gas discharged from each said internal cavity, to a common reservoir, only during a portion of said first time duration;

means to communicate gas from the atmosphere into said internal cavity only during a portion of said second time duration;

whereby said gas from said plurality of collapsible members between each said pair of planar members, is communicated to said common reservoir for storage in a pressurized state.

2. The compressor of claim 1 wherein said means to communicate gas discharged from each said internal cavity, to a common reservoir, during said first time duration comprises:

means for timed opening of a discharge valve from a closed position preventing communication of said air through a conduit running between said internal cavity and said reservoir, to an open position allowing said communication of air, said open position occurring only during said first time duration.

3. The compressor of claim 1 wherein means to communicate gas from the atmosphere into said internal cavity during an said second time duration comprises:

means for timed opening of an intake valve from a closed position preventing communication of said air into said internal cavity, to an open position allowing said communication of air into said internal cavity wherein said open position occurring only during said second time duration.

4. The compressor of claim 2 wherein means to communicate gas from the atmosphere into said internal cavity during an said second time duration comprises:

means for timed opening of an intake valve from a closed position preventing communication of said air into said internal cavity, to an open position allowing said communication of air into said internal cavity wherein said open position occurring only during said second time duration.

5. The compressor of claim 4 additionally comprising:

said means for timed opening of said discharge valve comprises a discharge valve engaged with said discharge aperture and having an open and biased to a closed position;

said discharge apertures in sealed communication with a reservoir when said discharge valve is in said open position;

said means for timed opening of an intake valve comprises an intake valve engaged with said intake aperture and having an open position and being biased to a closed position;

said intake apertures in communication with a gas supply when in said open position;

a first push rod communicating between said discharge valve and a rail, said rail having a first path adjacent to at least one of each said pair of planar members;

an engagement of said first push rod on said rail causing a translation of said first rod concurrently said discharge valve to said open position;

a second push rod communicating between said intake valve and a railing, said railing having a second path adjacent to at least one of each said pair of planar members; and an engagement of said second push rod on said railing causing a translation of said second pushrod, said translation moving said intake valve to said open position.

6. The compressor of claim 1 wherein said additionally means for rotational support of said frame above a surface comprises:

vertical support members adapted for engagement with said planar circular members; and bearings at an upper end of said support members adapted for engagement with said planar circular members.

7. An air compressor comprising:

an generally annular frame, said frame formed of a plurality of individual linear members, each linear member rotationally engaged at two ends, to an adjacent linear member of said plurality;

said frame having an exterior to a circumscribed area and an interior to said circumscribed area;

a planar circular member located at center portions of each of said linear members;

means for rotational support of said frame above a surface;

adjacent said planar circular members engaged to adjacent said linear members thereby forming a plurality of pairs of planar circular members;

said linear members being in angled engagement to adjacent linear members thereby imparting an angle of each planar circular member to the other in said pair;

a pathway formed between each said pair of planar circular members, said pathway being wider outside said circumscribed area, and narrowest inside said circumscribed area of said frame;

a plurality of collapsible members, engaged adjacent to a circular planar member circumference and in between each said pair of planar circular members;

said collapsible members having an internal cavity communicating with an intake aperture and a discharge aperture;

means for powered rotation of said circular planar members engaged to said linear members forming said frame thereby imparting a rotation of said linear members and said circular members toward said inside circumscribed area;

said collapsible members engaged between said each said pair of planar circular members alternating between an enlarged dimension at said outside circumscribed area to said inside circumscribed area, to a collapsed dimension at said interior to said frame circumscribed area, during each said rotation;

a first time duration during said rotation causing a translation of said collapsible members from said enlarged dimension to said collapsed dimension;

a second time duration during said rotation causing a second translation of said collapsible members from said collapsed dimension to said enlarged dimension;

means to communicate gas discharged from each said internal cavity, to a common reservoir, only during a portion of said first time duration;

means to communicate gas from the atmosphere into said internal cavity only during a portion of said second time duration; and whereby said gas from said plurality of collapsible members between each said pair of planar members, is communicated to said common reservoir for storage in a pressurized state.

8. The compressor of claim 1 additionally comprising:

a center relief in each said planar circular member, said center relief extending from a member circumference to a hub, said relief defining a gap between said side surfaces.

9. The compressor of claim 6 additionally comprising:

a center relief in a plurality of said planar circular members, said center relief extending from a member circumference to a hub, said relief defining a gap between said side surfaces; and said bearings adapted for rotational engagement with one or a plurality of said hubs.

* * * * *